US005737795A

United States Patent [19]

Murders

[11] Patent Number: 5,737,795

[45] Date of Patent: Apr. 14, 1998

[54] STIFFENED BULL FLOAT APPARATUS

[75] Inventor: Jack D. Murders, Fayetteville, Ark.

[73] Assignee: Marshalltown Trowel Company, Marshalltown, Iowa

[21] Appl. No.: 781,800

[22] Filed: Jan. 10, 1997

[51] Int. Cl.[6] ..... B05C 17/10; E01C 19/12

[52] U.S. Cl. ..... 15/235.4; 404/97

[58] Field of Search ..... 15/235.4–235.8, 15/236.01; 404/97, 118

[56] References Cited

U.S. PATENT DOCUMENTS

| | | | |
|---|---|---|---|
| 1,021,557 | 3/1912 | Runner . | |
| 1,306,135 | 6/1919 | Bricker . | |
| 1,501,192 | 7/1924 | Severns . | |
| 1,544,368 | 6/1925 | Brennan . | |
| 1,713,513 | 5/1929 | Abram . | |
| 1,763,066 | 6/1930 | Rooney . | |
| 1,797,484 | 3/1931 | Smith . | |
| 1,952,398 | 3/1934 | Tullis . | |
| 2,018,890 | 10/1935 | Heltzel . | |
| 2,834,199 | 5/1958 | Freeman . | |
| 3,082,460 | 3/1963 | Haivala . | |
| 3,613,243 | 10/1971 | Baker | 15/235.5 |
| 3,729,765 | 5/1973 | Peterson . | |
| 3,936,210 | 2/1976 | Oehlerking . | |
| 4,397,581 | 8/1983 | Jarvis . | |
| 4,399,583 | 8/1983 | Jarvis . | |
| 4,431,336 | 2/1984 | Nightengale et al. . | |
| 4,663,796 | 5/1987 | Helling et al. . | |
| 4,669,970 | 6/1987 | Perry | 15/235.7 |
| 4,722,637 | 2/1988 | Glesmann . | |
| 4,766,635 | 8/1988 | DeVitis . | |
| 4,856,932 | 8/1989 | Kraft . | |
| 4,892,437 | 1/1990 | Kraft . | |
| 5,115,536 | 5/1992 | Jarvis . | |
| 5,234,281 | 8/1993 | Somero et al. . | |
| 5,467,496 | 11/1995 | Jarvis . | |

*Primary Examiner*—Randall Chin

*Attorney, Agent, or Firm*—McAndrews, Held & Malloy, Ltd.

[57] ABSTRACT

A bull float for working and finishing concrete and the like is provided. The bull float includes a blade. The blade has a first working surface for contacting the work to be troweled. The first working surface has a leading edge and a trailing edge. The blade also has a leading edge member disposed at the leading edge and carries a second working surface disposed at an angle to the first working surface. The blade further includes a trailing edge member disposed at the trailing edge and carries a third working surface disposed at an angle to the first working surface. The bull float includes a planar metal sheet having a front edge and a rear edge, and having its mid area bowed outwardly relative to the working surface. The front and rear edge of the sheet are secured at points fixed with respect to the leading edge and the trailing edge. The sheet exerts uniform opposing bias forces to the leading edge and to the trailing edge of the blade to counteract residual compressive stresses developed on the first working surface during use of the float.

9 Claims, 4 Drawing Sheets

STIFFENED BULL FLOAT APPARATUS

BACKGROUND OF THE INVENTION

This invention relates generally to concrete working tools and more particularly, an improved stiffened bull float apparatus providing resistance against warping, as well as facilitating easy cleaning.

Numerous styles of concrete floats and other accessories for use in finishing concrete have been available in the marketplace for some time. For example, a bull float tool which is used for "bull floating" concrete is used in the sequence of concrete finishing. In particular, after the concrete is poured and screeded (leveled), and possibly tamped, a bull floating process is performed. The purpose of bull floating is to fill in low spots or remove high spots in a pour of concrete. A typical bull float is six to eight inches wide and three to five feet long. Typically, bull floats have been made from wood, aluminum, magnesium or steel.

However, certain problems result from the various materials used in the construction of bull floats. For example, a wood bull float has a portion in contact with the wet or damp concrete and the other edge exposed to rays of the sun when used outside during the summer. This situation presents problems. One such problem is that the wood will warp and twist. As a result, the wood bull float will not provide a straight edge for leveling the pour of concrete. In addition, such a board becomes heavy from contact with the moist concrete and is difficult to clean.

Also, problems occur with aluminum and magnesium bull floats. Magnesium bull floats especially tend to bow or distort so that the float becomes convex on the working surface in both the narrow and, more importantly, the lengthwise direction. The severity of the bowing and the amount of time it takes to deform this tool is dependent on several factors. These factors include weather situations, amount of use, etc.

Another chronic problem with magnesium bull floats is that the traditional design is difficult to keep clean on top of the bull float blade. Thus, some magnesium bull floats have extruded stiffeners to prevent the warping discussed above which unfortunately tend to collect concrete. It is very tedious and time-consuming for the user to keep removing the excess concrete that builds up on the top of the bull float.

Examples of bull float tools are shown in U.S. Pat. Nos. 5,467,496 and 4,397,581 to Jarvis. Specifically, U.S. Pat. No. 5,467,496 discloses a float incorporating a body portion which has a reinforcing brace. However, the top surface of the float can collect concrete material during use.

A need, therefore, exists for an improved bull float. The bull float should prevent warping as well as be easy to clean.

BRIEF SUMMARY OF THE INVENTION

A bull float for working and finishing concrete and the like is provided. The bull float includes a blade. The blade has a first working surface for contacting the work to be troweled. The first working surface has a leading edge and a trailing edge. The blade also has a leading edge member disposed at the leading edge and carries a second working surface disposed at an angle to the first working surface. The blade further includes a trailing edge member disposed at the trailing edge and carries a third working surface disposed at an angle to the first working surface. The bull float includes a planar metal sheet having a from edge and a rear edge, and having its mid area bowed outwardly relative to the working surface. The from and rear edge of the sheet are secured at points fixed with respect to the leading edge and the trailing edge. The sheet exerts uniform opposing bias forces to the leading edge and to the trailing edge of the blade to counteract residual compressive stresses developed on the first working surface during use of the float.

The current invention improves upon the features of existing bull floats by providing a stiffening element to prevent torque and warping of the tool, as well as providing for much easier cleaning than existing bull floats on the market provide.

DETAILED DESCRIPTION OF THE INVENTION

Figure 1:
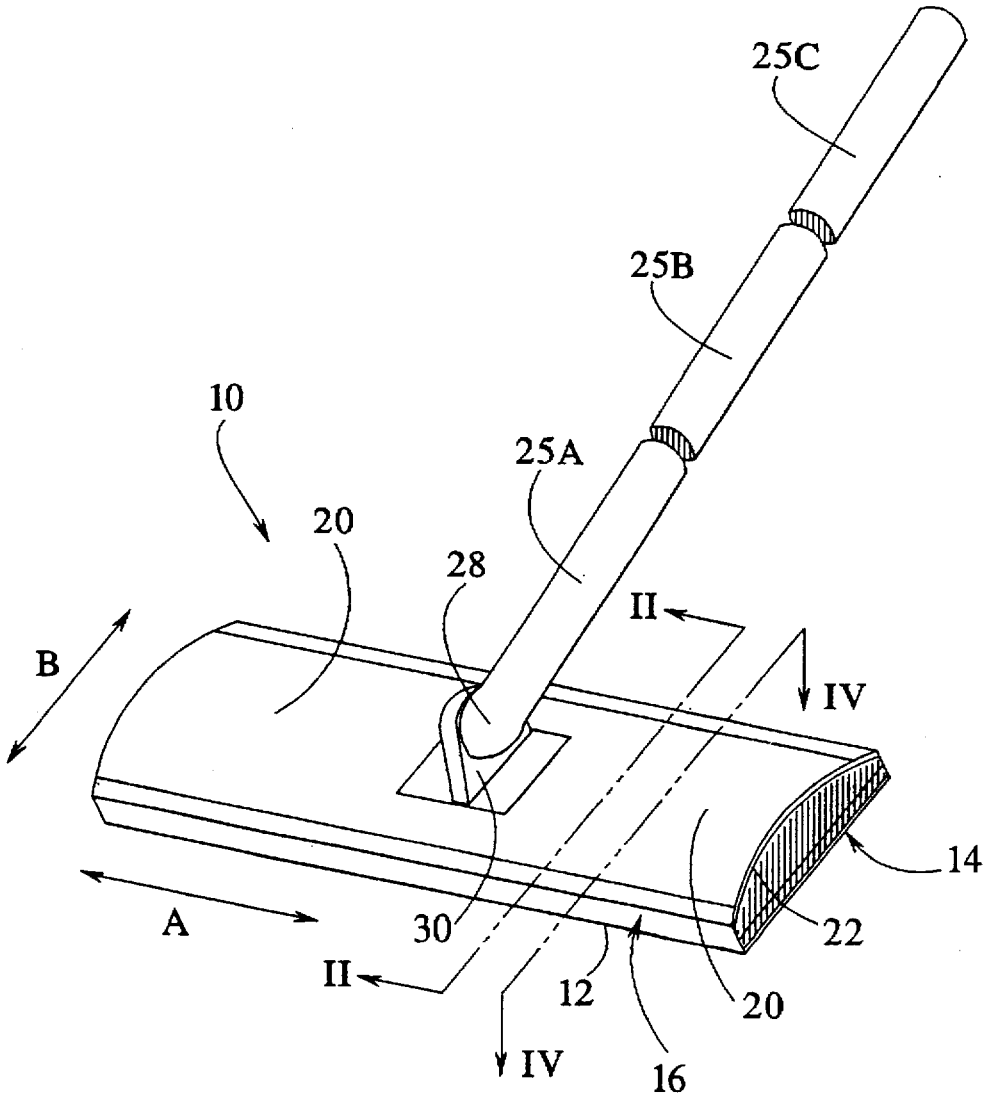
FIG. 1 is a perspective view of an embodiment of the bull float of the present invention illustrating a sectioned elongated handle.

Referring specifically to FIG. 1, the improved bull float apparatus of the present invention is shown generally at 10. The bull float 10 includes a blade portion 12. The blade portion 12 preferably is extruded of a lightweight, yet durable material, particularly metal. Examples of the preferred metals include aluminum and magnesium. The blade portion 12 also includes a working surface 14 which is in contact with the cement during operation of the bull float 10. The blade portion 12 has a longitudinal length and a width. Preferred sizes for the blade portion 12 include a length of forty-eight inches and a width of eight inches.

The blade portion 12 also includes an approximately vertical portion 16 formed along the longitudinal length on each side of the working surface 14. The improved bull float apparatus 10 also includes a stiffener 20. The stiffener 20 preferably is a prestressed metal mounted between the vertical portions 16 of the blade portion 12 of the bull float 10. The preferred stiffener 20 is formed of a 0.026 inch thick milled steel plate. The preferred arrangement of the stiffener 20 is described below with reference to FIG. 2.

In addition, the bull float 10 includes an insert 22. The insert 22 is preferably located at each end of the stiffener 20 between the blade portion 12 and the stiffener 20. The insert 22 prevents material, for example, concrete, from entering the ends of the float 10 and accumulating between the working surface 14 and the stiffener 20. This avoids the common problem encountered with many bull floats of accumulating concrete material, thus weighing down the bull float and making operation difficult. As illustrated in FIG. 1, the stiffener 20 is arranged in a direction indicated by arrow A, which is along the longitudinal length of the bull float 10, within the blade potion 12. This is roughly perpendicular to the direction of use of the bull float 10 indicated by arrow B.

The illustrated embodiment of the bull float 10 preferably includes a segmented handle referenced 25A, 25B and 25C. The handle may be assembled to a desired length by the user by connecting as many of the handle segments 25A, 25B, 25C as required. Handle segment 25A has a mounting end 28 which can be adjustably fastened to a handle attachment base 30. The angle of the handle with respect to the concrete surface can also be adjusted. The handle attachment base 30 is described further below with reference to FIG. 2.

Figure 2:
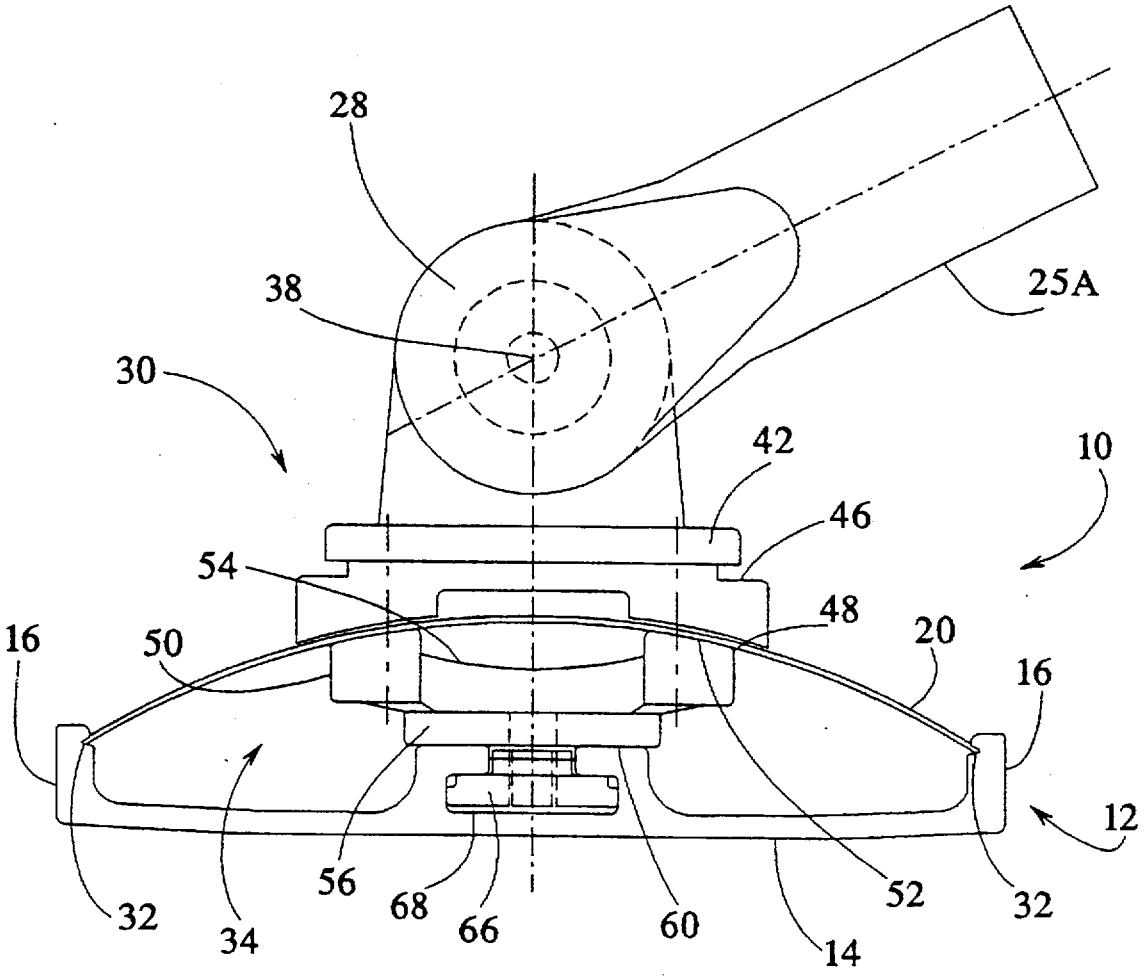
FIG. 2 is a side cross-sectional view of an embodiment of the bull float of the present invention taken along section line II—II of FIG. 1.

FIG. 2 is a side-sectional view of the embodiment of the bull float 10 illustrated in FIG. 1. Like parts are referenced with like numerals. Thus, FIG. 2 illustrates the blade portion 12 of the bull float 10 including the vertical portions 16 and the working surface 14. The stiffener 20 is also shown mounted within the vertical portions 16.

In the preferred embodiment, a notch 32 is provided in each vertical portion 16 along the longitudinal line indicated by arrow A (FIG. 1). Preferably, the notch 32 runs the entire length of the blade portion 12. The notch 32 is also located near the top of the vertical portion 16 so that concrete or other material does not accumulate on the float 10 between the vertical portion 16 and the stiffener 20. The arched shape of the stiffener 20 further provides an efficient way to keep concrete off of the bull float 10. The concrete simply-rolls off the stiffener 20 and over the vertical portion 16. The stiffener 20 essentially seals the top of the float 10 so that any crevices and corners are covered. Thus, the float 10 is easier to clean and requires less cleaning.

FIG. 2 also illustrates that the stiffener 20 and the blade portion 12 combine to form an open interior space 34. The open interior space 34 defined between, the stiffener 20 and the top of the blade portion 12 is enclosed and sealed by the insert 22 shown in FIG. 1. The insert 22 is preferably formed of a resilient material shaped to fit in the open space 34 at each end of blade, portion 12. The insert 22, also provides a resilient, yet firm, support for the stiffener 20. The insert 22 has an additional advantage of absorbing vibrations that may be generated in the bull float 10 during use. These vibrations would likely be transmitted through the handle to the hands of a user. Thus, the reduction of vibrations resulting from the insert 22 makes the tool easier to use by advantageously reducing fatigue on the operator.

When the stiffener 20 is assembled in the notch 32 of the blade portion 12 of the bull float 10, the cross-sectional modulus (stiffness) of the float 10 increases by a factor of approximately twelve. The increase in stiffness offsets the residual compressive stresses that build-up on the working surface 14 as the bull float 10 is used. As a result, the shape and flatness of the float 10 remains virtually unchanged over a long period of use. The bowing and distortion is also reduced by a factor of twelve.

FIG. 2 also illustrates the handle portion 25A mounted to the attachment base 30 about an axis of rotation 38 (into the page). The attachment base 30 has a base portion 42 which mounts to an adapter 46. The adapter 46 has a curved face 48 which cooperates with the curvature of the stiffener 20. Thus, the curved face 48 of the adapter 46 holds the stiffener 20 in the arched orientation illustrated. The stiffener 20 is arranged between the adapter 46 and a bracket 50. The bracket 50 also has curved surfaces 52 which cooperate with the curvature of the stiffener 20. The bracket 50 has a body portion 54 illustrated more clearly in FIG. 3. The body portion 54 includes a bottom 56 which mounts to a plateau surface 60 formed as part of the blade portion 12. The bottom 56 (FIG. 2) of the bracket 50 is secured to the blade portion 12 by a T-nut 66. The T-nut 66 is confined within a T-shaped channel 68 formed in the blade portion 12 beneath the plateau surface 60. Preferably, the bracket 50 is formed of a casting, as is the T-nut 66. However, the blade portion 12 is preferably an extrusion.

Figure 3:
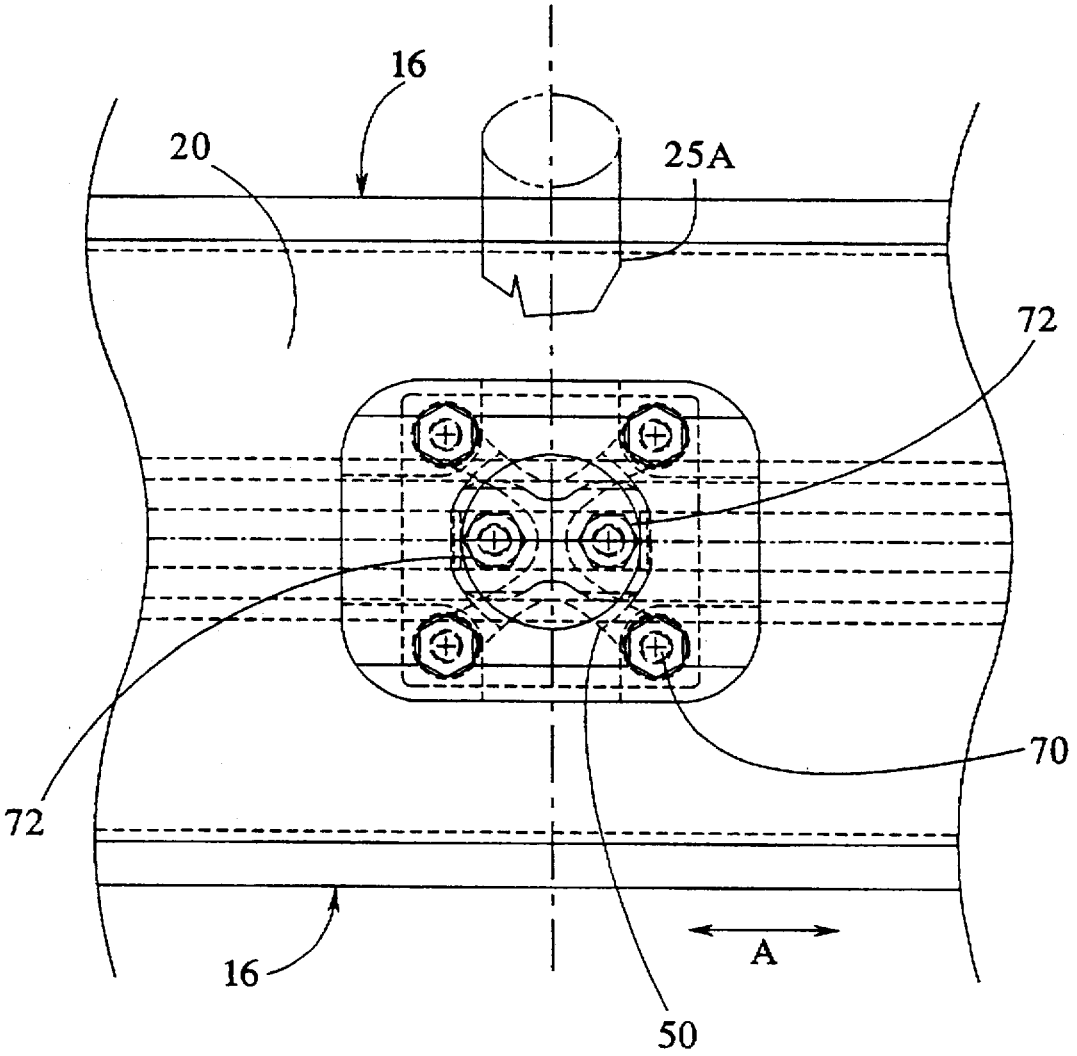
FIG. 3 is a top view of an embodiment of a bracket for connecting the bull float to the handle.

FIG. 3 is a top view of a region of the bull float 10 showing where the handle portion 25A is connected to the attachment base 30. As illustrated, fasteners 70 are provided to secure the base portion 42 to the adapter 46, as well as securing the stiffener 20 between the adapter 46 and the curved surface 52 of the bracket 50. The fasteners 70 may be screws, bolts, etc. The T-nut 66 is adjustable longitudinally in the direction indicated by arrow A, depending on the user's preference. In addition, fasteners 72 are illustrated in FIG. 3. The fasteners 72 provide a connection between the T-nut 66 and the bottom 56 of the bracket 50.

Figure 4A:
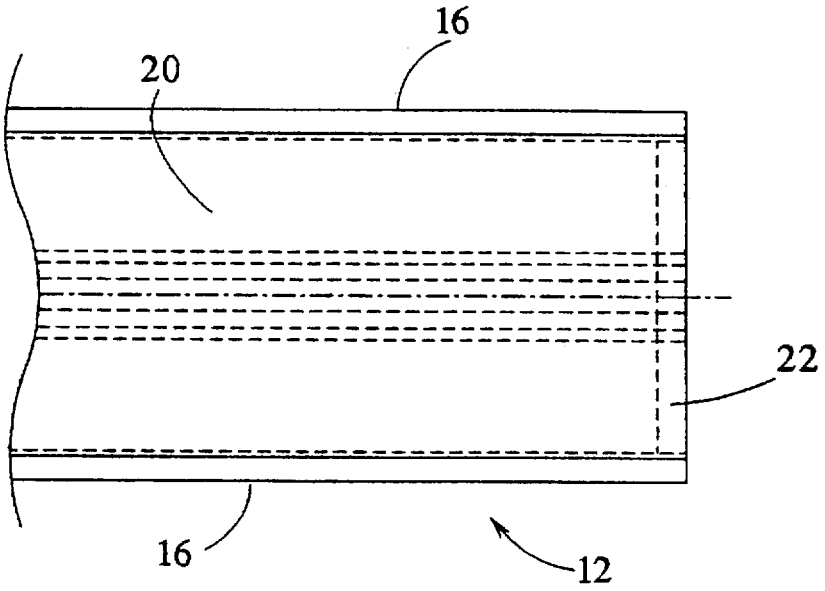
FIG. 4A is a top view of an end of a blade and stiffener portion of the bull float illustrating an embodiment wherein the stiffener has the same length as the blade portion of the bull float.

FIG. 4A illustrates an end portion of the embodiment of the bull float 10. Like parts are referenced with like numerals. For example, the blade portion 12 of the bull float 10 is illustrated having the vertical portions 16 bordering along the longitudinal edges of the stiffener 20. The stiffener 20 extends to the end of the blade portion 12 and the insert 22 is positioned in the open space 34 at the end to avoid entrance of any cement into the open space 34 between the stiffener 20 and the blade portion 12.

Figure 4B:
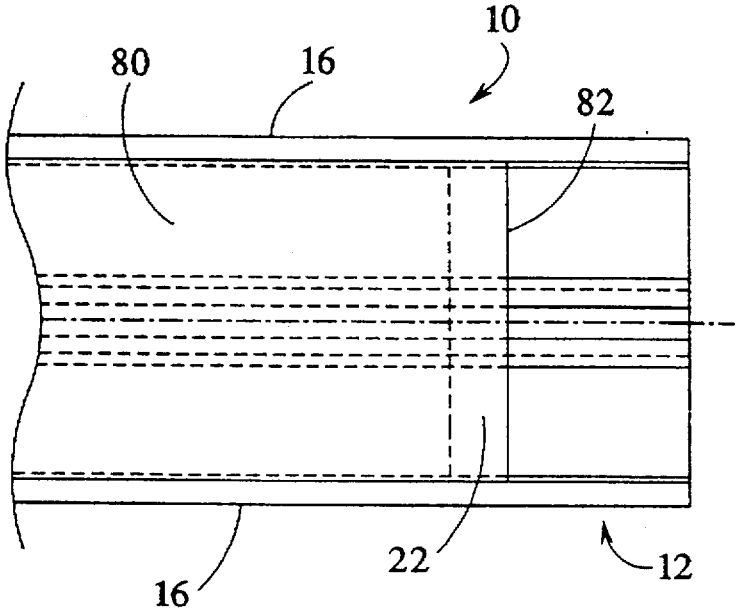
FIG. 4B is a top view of an end of the bull float illustrating another embodiment wherein the stiffener has a length shorter than the length of the blade portion of the bull float.

FIG. 4B illustrates another embodiment of the bull float 10 of the present invention. An alternate embodiment of the stiffener 20 is illustrated generally at 80. As shown in FIG. 4, the stiffener 80 is not equal in length to the blade portion 12 of the bull float 10. In this embodiment, since the stiffener is shorter than the blade portion 12, an edge 82 of the alternate stiffener 80 does not extend to the end of the blade portion 12. Thus, the insert 22 must be located a distance in from the end of the blade portion 12 to prevent cement from entering the open space 34, indicated more clearly in FIG. 2.

While particular elements, embodiments and applications of the present invention have been shown and described, it will be understood, of course, that the invention is not limited thereto since modifications may be made by those skilled in the art, particularly in light of the foregoing teachings. It is, therefore, contemplated by the appended claims to cover such modifications as incorporate those features which come within the spirit and scope of the invention.

I claim:

1. A bull float, comprising:

a blade, said blade having a working surface and a pair of opposing substantially vertical members, a notch located in each of said opposing substantially vertical members, and a stiffener, said stiffener partially disposed within said notches, said stiffener being bowed outwardly from said working surface.

2. The bull float of claim 1, wherein said stiffener extends approximately the entire length of said blade.

3. The bull float of claim 1, wherein said blade has longitudinal edges and said opposing vertical members located along said edges.

4. The bull float of claim 1, further including an insert disposed between said blade and said stiffener.

5. A bull float, comprising:

a blade, said blade having (1) a substantially planar first working surface for contacting the work to be troweled, said first working surface having a leading edge and a trailing edge;

(2) a top surface, said top surface substantially parallel to said first working surface, said first working surface and said top surface defining a blade thickness;

(3) a leading edge member disposed at said leading edge and carrying a second working surface disposed at an angle to said first working surface and said second working surface extending above said top surface;

(4) a trailing edge member disposed at said trailing edge and carrying a third working surface disposed at an angle to said first working surface and said third working surface extending above said top surface; and means for counteracting residual compressive stresses developed on said first working surface during use of the float, said means including a metal sheet having a front edge and a rear edge, and having its mid area bowed outwardly relative to said first working surface, said front and rear edge of said sheet being substantially parallel to said leading edge and secured at points fixed with respect to said leading edge and said trailing edge, said sheet positioned relative to said blade for exerting uniform opposing bias forces to said leading edge and to said trailing edge of said blade to counteract residual compressive stresses developed on the first working surface during use of the float.

6. A bull float according to claim 5 wherein said metal sheet is connected to said leading edge member and said trailing edge member.

7. A bull float according to claim 5, wherein said metal sheet extends approximately the entire length of said blade.

8. A bull float, comprising:

a blade, said blade having (1) a substantially planar first working surface for contacting the work to be troweled, said first working surface having a leading edge and a trailing edge;

(2) a top surface, said top surface substantially parallel to said first working surface, said first working surface and said top surface defining a blade thickness;

(3) a leading edge member disposed at said leading edge and carrying a second working surface disposed at an angle to said first working surface and said second working surface extending above said top surface;

(4) a trailing edge member disposed at said trailing edge and carrying a third working surface disposed at an angle to said first working surface and said third working surface extending above said top surface;

a metal sheet having a front edge and a rear edge, and having its mid area bowed outwardly relative to said first working surface, said front and rear edge of said sheet being substantially parallel to said leading edge and secured at points fixed with respect to said leading edge and said trailing edge, said sheet positioned relative to said blade for exerting uniform opposing bias forces to said leading edge and to said trailing edge of said blade to counteract residual compressive stresses developed on the first working surface during use of the float, said sheet of metal being connected to said leading edge member and said trailing edge member; and each said leading edge member and said trailing edge member having an interior sidewall and further comprising:

a notch formed on the interior sidewall of said members, said notch being formed of a size for receiving the front and rear edges of said metal sheet.

9. A bull float, comprising:

a blade, said blade having (1) a substantially planar first working surface for contacting the work to be troweled, said first working surface having a leading edge and a trailing edge;

(2) a top surface, said top surface substantially parallel to said first working surface, said first working surface and said top surface defining a blade thickness;

(3) a leading edge member disposed at said leading edge and carrying a second working surface disposed at an angle to said first working surface and said second working surface extending above said top surface;

(4) a trailing edge member disposed at said trailing edge and carrying a third working surface disposed at an angle to said first working surface and said third working surface extending above said top surface;

a metal sheet having a front edge and a rear edge, and having its mid area bowed outwardly relative to said first working surface, said front and rear edge of said sheet being substantially parallel to said leading edge and secured at points fixed with respect to said leading edge and said trailing edge, said sheet positioned relative to said blade for exerting uniform opposing bias forces to said leading edge and to said trailing edge of said blade to counteract residual compressive stresses developed on the first working surface during use of the float; and end caps inserted at lateral edges of said blade between said metal sheet and said blade, said end caps forming a closed lateral wall at each end of the float.

* * * * *